United States Patent [19]

Liu et al.

[11] Patent Number: 5,017,157

[45] Date of Patent: May 21, 1991

[54] RECEPTACLE FOR CABLE CONNECTOR WITH LOCKING MECHANISM AND ELECTRIC SHIELDING PROPERTY

[75] Inventors: Yun-Yu Liu; Hsiao-Lei Shih, both of Taipei, Taiwan

[73] Assignee: Pan-International Industrial Corp., Hsin-Tien-Taipei Hsien, Taiwan

[21] Appl. No.: 510,182

[22] Filed: Apr. 17, 1990

[51] Int. Cl.[5] ..... H01R 13/648

[52] U.S. Cl. ..... 439/609; 439/353

[58] Field of Search ..... 439/609, 610, 98, 906, 439/607, 608

[56] References Cited

U.S. PATENT DOCUMENTS

| | | | |
|---|---|---|---|
| 4,106,839 | 8/1978 | Cooper | 439/609 |
| 4,611,878 | 9/1986 | Hall et al. | 439/610 |
| 4,894,026 | 1/1990 | Dixon et al. | 439/609 |
| 4,929,189 | 5/1990 | Sekiguchi | 439/352 |

FOREIGN PATENT DOCUMENTS

| | | | |
|---|---|---|---|
| 2074798 | 11/1981 | United Kingdom | 439/607 |

*Primary Examiner*—Gary F. Paumen
*Assistant Examiner*—Kevin J. Carroll
*Attorney, Agent, or Firm*—Fleit, Jacobson, Cohn, Price, Holman & Stern

[57] ABSTRACT

A receptacle for cable connector with locking mechanism and electric shielding property, which includes a socket having a circular recessed portion at the front end for the setting therein of a metal hoop to hold a dielectric core. The metal hoop comprises a plurality of resilient strips projecting from its inner wall surface and disposed in a gap between the socket and the dielectric core so as to produce a retaining force onto the metal fastening tube of the cable plug which is inserted therein to reinforce the connection and improve electric shielding effect. An opening is made on the metal hoop so that a channel is defined between the metal hoop and the circular recessed portion of the socket for the fastening therein of the unitary hook portion of the metal fastening tube of the cable plug.

4 Claims, 4 Drawing Sheets

RECEPTACLE FOR CABLE CONNECTOR WITH LOCKING MECHANISM AND ELECTRIC SHIELDING PROPERTY

BACKGROUND OF THE INVENTION

The present invention relates to receptacles for cable connectors, and more particularly to a receptacle for a cable connector which includes a metal hoop set between a rubber or dielectric core and the casing thereof, to provide a reaction force or retaining force onto the fastening tube of the plug which is connected.

The conventional cable connectors are generally comprised of a cable plug incorporated with a receptacle. The cable plug comprises a metal fastening tube and a plurality of plug pins therein, and the receptacle comprises a casing having received therein a socket to hold a rubber core. When in operation, the metal fastening tube of the plug is inserted in the socket and the plug pins are respectively inserted in the plug holes of the rubber core for electric connection. The connection of the cable plug with the receptacle is retained by means of the binding force between the plug pins and the metal fastening tube. There is not any further locking mechanism available to reinforce the connection of the cable plug and the receptacle. Therefore, a contact failure problem happens quite often. In order to secure the connection of a cable plug to a receptacle, screw means may be used to fasten together the two parts of the casing of a receptacle after a cable plug is inserted. However, the use of screw means on a receptacle makes the structure of such a receptacle more complicated to operate and more expensive to manufacture. Another disadvantage of the conventional cable connectors is that there is no electric shielding arrangement to protect against electromagnetic interference. The present invention is specifically designed to solve the aforesaid problems.

SUMMARY OF THE INVENTION

A receptacle for cable connector in accordance with the present invention includes a metal hoop received in a casing between a rubber core and a socket. The metal hoop comprises a plurality of resilient strips projecting from its inner wall surface and respectively set in the gap between the rubber core and the socket. When the metal fastening tube of a cable plug is inserted in the gap, the resilient strips of the metal hoop produce a retaining force onto the metal fastening tube to secure such a cable plug to the receptacle, and a good electric shielding effect is simultaneously achieved. An opening is made in the metal hoop so that a channel can be defined between the metal hoop and the front edge of a circular recessed portion on the socket for the fastening therein of the unitary hook portion of the metal fastening tube of a cable plug.

DETAILED DESCRIPTION OF THE PREFERRED EMBODIMENTS

Figure 1:
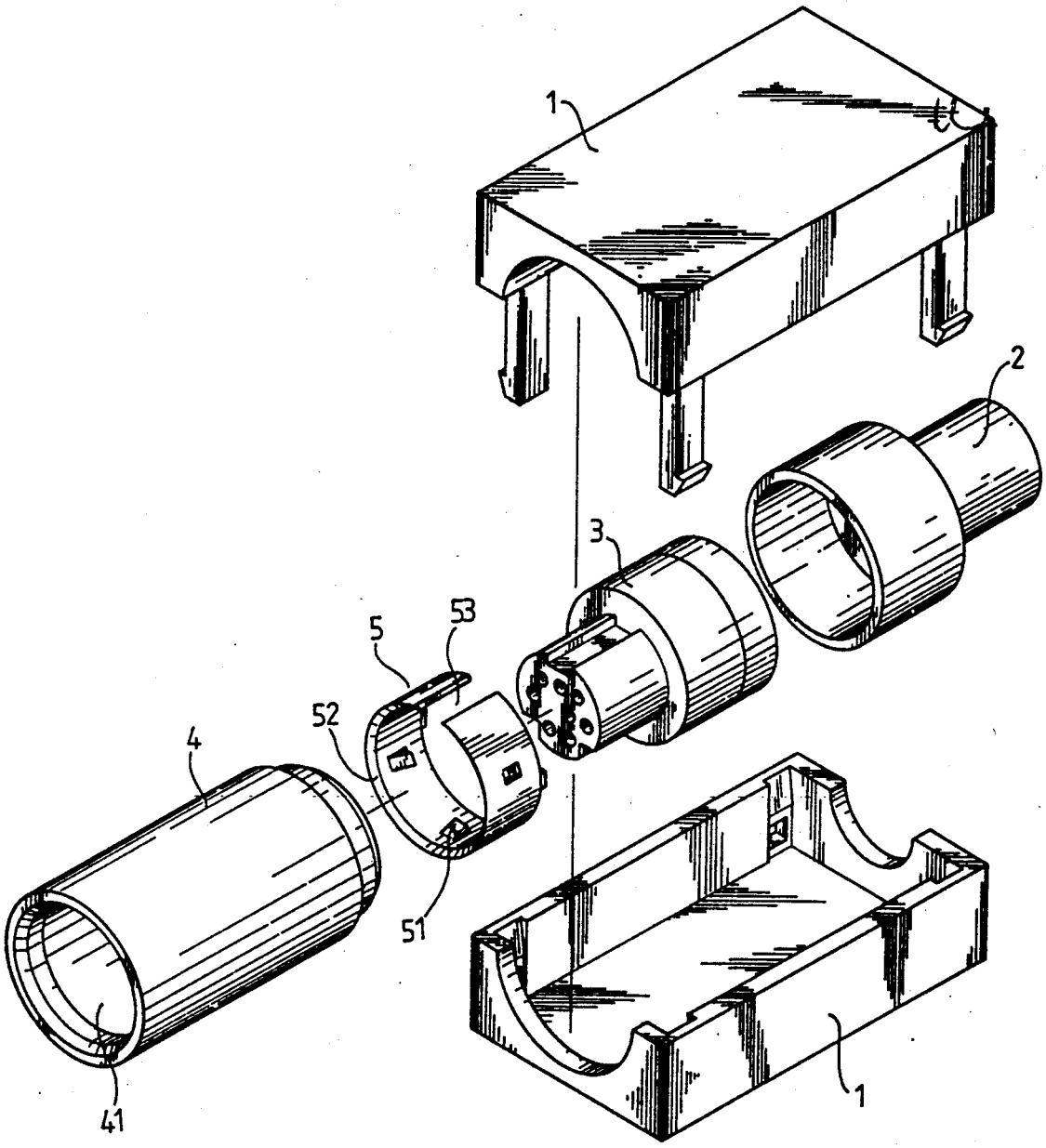
FIG. 1 is a perspective exploded view of the present invention.
Figure 2:
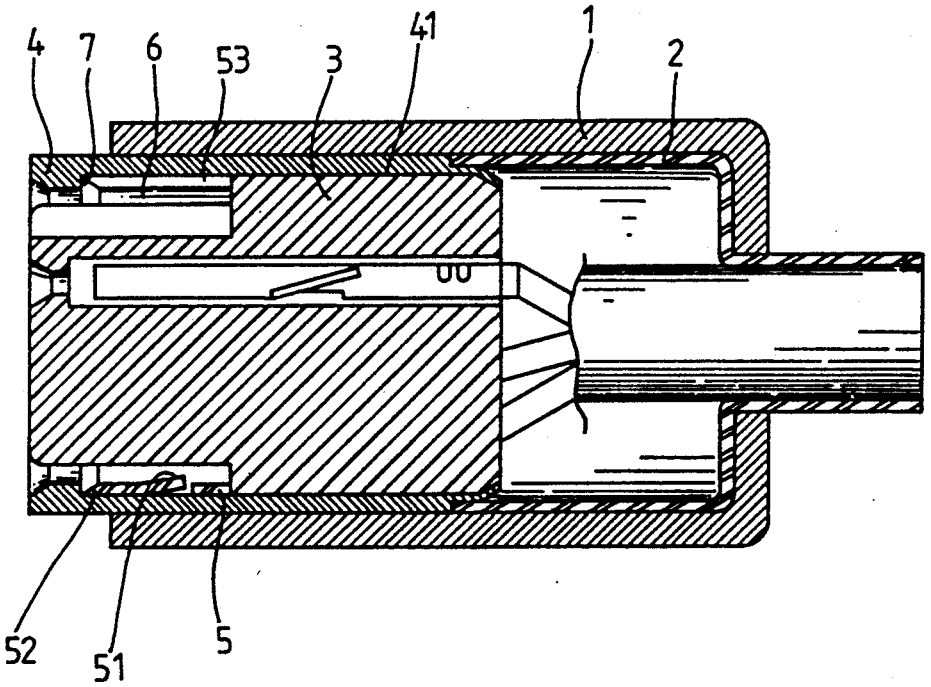
FIG. 2 is a sectional assembled view thereof.
Figure 3:
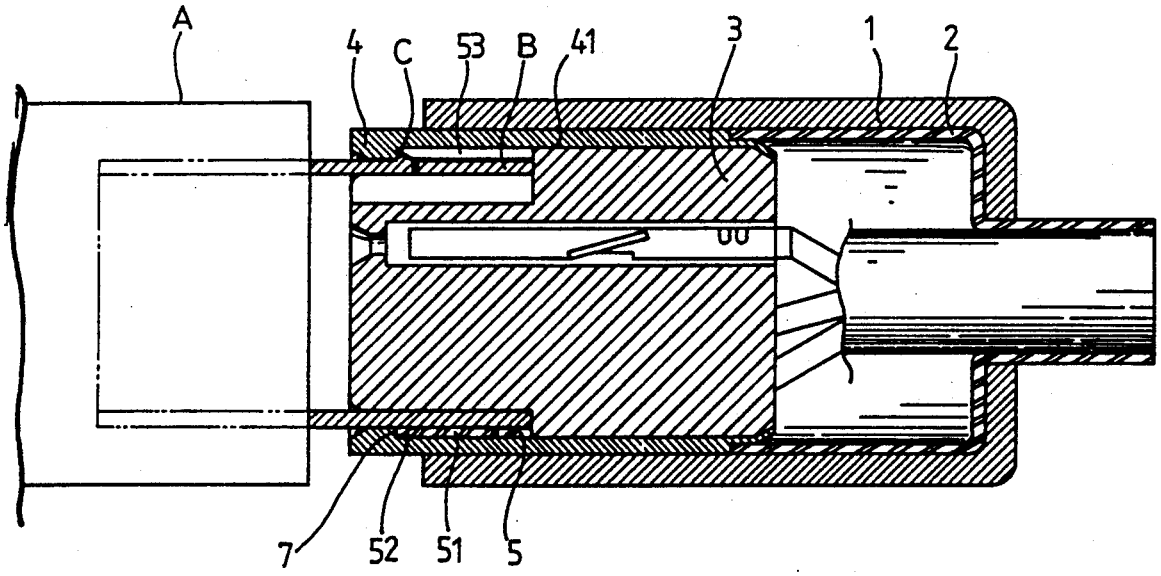
FIG. 3 is a schematic drawing illustrating the operation of the present invention.

Referring to FIG. 1, a receptacle for a cable connector in accordance with the present invention is generally comprised of a casing (1), a metal cap (2), a rubber core (3), a socket (4) and a metal hoop (5). The metal hoop (5) is set in a circular recessed portion (41) on the inner wall of the socket (4) at one end, which comprises a plurality of resilient strips (51) projecting from its inner wall surface, a tangent plane (52) on its front edge for guidance, and an opening (53). As illustrated in FIG. 2, after the metal hoop (5) is mounted on the front end of the rubber core (3), the socket (4) is sleeved on the metal hoop (5) and the rubber core (3) from the front end to firmly hold them together, and the metal cap (2) is mounted on the rubber core (3) from its rear end to connect to the socket (4) in series and to form therewith a metal shielding body. Thus, the resilient projecting strips (51) of the metal hoop (5) are disposed in the gap (6) between the rubber core (3) and the socket (4), and a channel (7) is formed between the opening (53) of the metal hoop (5) and the front edge of the circular recessed portion (41) of the socket (4). When the metal fastening tube (B) of a regular cable plug (A) is inserted in the circular gap (6) between the socket (4) and the rubber core (3), the resilient strips (51) of the metal hoop (5) are simultaneously squeezed by the metal fastening tube (B), as shown in FIG. 3, therefore, the plug (A) is firmly retained by means of the reactive force or retaining force of the resilient strips (51) and the elastic resilient property of the metal hoop (5), and good electric shielding performance is achieved.

Figure 4:
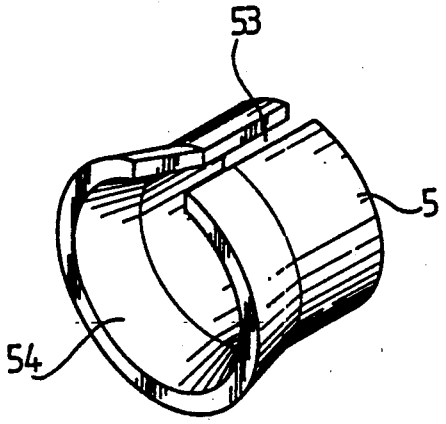
FIG. 4 illustrates an alternate form of the metal hoop according to the present invention.
Figure 5:
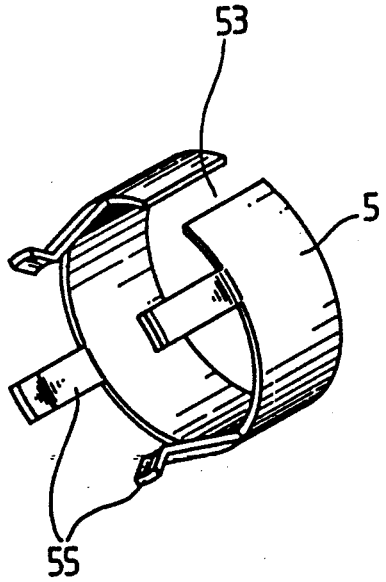
FIG. 5 illustrates still another alternate form of the metal hoop according to the present invention.

Referring to FIGS. 4 and 5, there are illustrated two alternate forms of a metal hoop according to the present invention, both of which comprise an opening (53) permitting the structure more flexibility. The metal hoop (5) of FIG. 4 comprises a front guiding portion (54) with a diameter gradually increasing outward. The metal hoop (5) of FIG. 5 comprises a pawl portion (55). Both the front guiding portion (54) and the pawl portion (55) can provide a retaining force to firmly retain the metal fastening tube (B).

Referring to FIG. 3 again, when a plug (A) whose metal fastening tube (B) comprises a resilient hook portion (C) (as illustrated in the dotted line) is connected to the present invention, the resilient strips (51) are squeezed to produce a retaining force on the plug (A), the hook portion (C) of the metal fastening tube (B) is fastened in the channel (7) between the metal hoop (5) and the circular recessed portion (41) of the socket (4) so that the plug (A) can be firmly retained in the receptacle.

We claim:

1. A receptacle for a cable connector, including: a casing;

a dielectric core received in said casing and having a plurality of holes for insertion of plug pins;

a metal cap mounted on the rear end of said dielectric core and received in said casing;

a separate metal hoop having resilient means projecting from a wall surface thereof, and an opening along the wall surface to provide the metal hoop with an elastic resilient property, said metal hoop being mounted on the front end of said dielectric core and received in said casing;

a metal socket having a circular recessed portion on its inner wall at the front end thereof and being received in said casing and sleeved on said metal hoop and said dielectric core to connect to said metal cap in series for electric shielding;

wherein a gap is formed between said dielectric core and said socket for the insertion therein of a metal fastening tube of a cable plug to squeeze the resilient means of said metal hoop, and a channel is formed between said metal hoop and the recessed portion of said socket for the fastening therein of a unitary hook portion on the metal fastening tube of said cable plug permitting said plug be firmly retained in the receptacle.

2. A receptacle for a cable connector as claimed in claim 1, wherein said resilient means is a front guiding portion on said metal hoop having a diameter gradually increasing outward to facilitate the fastening therein of the metal fastening tube of a cable plug.

3. A receptacle for a cable connector as claimed in claim 1, wherein said resilient means comprises at least one pawl portion extending forward and outward from the front end of said metal hoop.

4. A receptacle for a cable connector as claimed in claim 1, wherein said resilient means are strips projecting from the wall surface.

* * * * *